US005097534A

United States Patent [19]

Viemeister et al.

[11] Patent Number: 5,097,534

[45] Date of Patent: Mar. 24, 1992

[54] PROTECTIVE GARMENT

[75] Inventors: Tucker Viemeister, New York, N.Y.; Daniel Formosa, Montville; Stephen Russak, Hoboken, both of N.J.

[73] Assignee: Chicopee, New Brunswick, N.J.

[21] Appl. No.: 681,232

[22] Filed: Apr. 5, 1991

[51] Int. Cl.[5] ..... A41D 13/00

[52] U.S. Cl. ..... 2/69; 2/84; 2/114; 2/DIG. 7; 223/37

[58] Field of Search ..... 2/52, 59, 69, 75, 76, 2/80, 84, 105, 106, 127, 114, 202, 141 R, 141 A, 160, 270, DIG. 7; 223/37, 38

[56] References Cited

U.S. PATENT DOCUMENTS

| | | | |
|---|---|---|---|
| 821,977 | 5/1906 | Barker | 2/270 |
| 1,067,537 | 7/1913 | Miles | 2/76 |
| 1,131,532 | 3/1915 | McClure | 2/114 |
| 1,294,037 | 2/1919 | Bradley | 2/76 |
| 1,800,051 | 4/1931 | Blanco | 2/206 |
| 1,873,954 | 8/1932 | Cooper | 223/37 |
| 2,597,710 | 5/1952 | Delman | 2/76 X |
| 2,661,477 | 12/1953 | Gilbertson | 2/76 X |
| 3,045,813 | 7/1962 | Abildgaard | 2/114 |
| 3,259,913 | 7/1966 | Tames | 2/52 X |
| 3,359,569 | 12/1967 | Rotanz et al. | 2/114 |
| 3,429,433 | 2/1969 | Holt | 2/DIG. 7 X |
| 3,570,012 | 3/1971 | Winters | 2/114 |
| 3,721,999 | 3/1973 | Goya et al. | 2/114 |
| 4,205,398 | 6/1980 | Blume | 2/114 |
| 4,384,370 | 5/1983 | Singer | 2/114 |
| 4,457,026 | 7/1984 | Morris | 2/114 X |
| 4,523,335 | 6/1985 | Scrivens | 2/114 |
| 4,622,699 | 11/1986 | Spriggs | 2/114 |
| 4,736,467 | 4/1988 | Schwarze et al. | 2/114 |
| 4,752,972 | 6/1988 | Neckerman et al. | 2/DIG. 7 |
| 4,783,854 | 11/1988 | Bjorklund | 2/114 |
| 4,837,863 | 6/1989 | Van Scoy-Mosher | 2/114 |
| 4,845,779 | 7/1989 | Wheeler et al. | 2/69 X |
| 4,887,316 | 12/1989 | Morandini | 2/174 |
| 4,932,078 | 6/1990 | Jones et al. | 2/DIG. 7 X |
| 4,942,987 | 7/1990 | Stackhouse | 2/DIG. 7 |
| 4,991,232 | 2/1991 | Taylor | 2/DIG. 7 |
| 5,005,216 | 4/1991 | Blackburn et al. | 2/84 X |

FOREIGN PATENT DOCUMENTS

| | | | |
|---|---|---|---|
| 2329219 | 3/1975 | France | 2/DIG. 7 |
| 287546 | 5/1928 | United Kingdom | 2/59 |
| 526679 | 9/1940 | United Kingdom | 2/270 |

*Primary Examiner*—Werner H. Schroeder
*Assistant Examiner*—Jeanette E. Chapman

[57] ABSTRACT

A protective garment is provided with features which facilitate the donning thereof in accordance with current aseptic principles and which maintains a tight fit to preclude contamination during use and which is both comfortable and usable by a wide range of differently sized wearers. Specifically, a gown is folded in such a way as to present only inside surfaces to the assistant who aids the donner in donning the gown. Additionally, the gown is provided with cuffs and collar having stretch and recovery properties to aid in donning and front and back pleats to aid in donning as well as accommodating wearers of different size.

10 Claims, 10 Drawing Sheets

10
16
18
28
36
21
12
22
26
24
22
40
20
24
40
30
32
14
14

10
16
28
18
36
12
26
22
36
20
24
34
14
14

PROTECTIVE GARMENT

BACKGROUND OF THE INVENTION

This invention relates to protective garments and in particular, to such garments as are used in hospitals such as sterile surgical gowns worn by surgeons and other operating room personnel to prevent contamination of the patient, surgical instruments, operating room equipment, and other personnel by contact with the clothes or body surfaces of the wearer. Additionally, such gowns serve to protect the wearer from undesired contact with blood, wound exudates, and similar fluids encountered during surgical procedures.

The gowns may be constructed of woven or nonwoven material and are generally manufactured and folded into a compact package and sterilized before sale using for example, steam or ethylene oxide sterilization techniques. Such gowns have a general structure directed toward two basic modes of donning: the panel closure method and the over-the-head method. Gowns constructed for the panel closure method comprise generally a sheet of gown material being divided longitudinally into a central panel and two side panels. The central panel may be donned by overlying the front of the user's body with the side panels covering and closing at the user's back and hence are termed "back closing" gowns. Alternatively, the central panel may be donned overlying the back of the user's body with the side panels covering and closing at the user's front and hence are termed "front closing" gowns. In either event, the gowns are provided with a neck opening and sleeves for accommodating the wearer's head and arms.

In the second mode of donning, the gown comprises essentially a longitudinal tube having a bottom opening, sleeve openings to which sleeves are affixed and a neck opening. Such gowns are intended for the over-the-head donning wherein the wearer inserts his head and arms through the bottom of the gown and then through the neck opening and sleeves, respectively.

Irrespective of the mode of donning, for reasons of asepsis as well as general convenience and practicality, several considerations must be accounted for in the design and use of such gowns. For example, in preparing for surgery, the surgeon first thoroughly scrubs his hands and arms for an extended period of time before he next puts on his sterile surgical gown. The surgeon must put on his gown aseptically, that is he must use a gowning procedure which will both insure that the sterile character of the gown or at least the sterile character of the surfaces thereof which will face the patient and the operating table, will be preserved and that the surgeon himself will not contact surfaces that are in fact contaminated or which are deemed to be contaminated.

The surgeon, for all practical purposes, is unable to completely and aseptically don such gowns without the assistance of another person and hence operating room procedures provide two classes of personnel available to provide such assistance. Members of the first of these classes are generally referred to as "non-sterile" persons. A non-sterile person is one who has not been through a standard scrubbing procedure prior to entering the operating theater and, accordingly, any surface contact by such non-sterile person is deemed contaminated. Typically, the circulating nurse in the operating room is non-sterile. Other personnel, that is to say the scrub nurse, the surgeons and their operating assistants, are "sterile" persons. A sterile person is one who has undergone a standard scrubbing procedure in preparation for the operation and who is suitably outfitted e.g. with gown, gloves, hood, feet, and face coverings to insure against subsequent contamination. Typically, it is the non-sterile person who assists the sterile people in donning their gowns and hence one criterion for the design and folding of such gowns is that consideration must be given to allow a non-sterile person to assist in the donning without contaminating those surfaces of the gown which must remain sterile; generally the outside surfaces.

In addition to consideration in connection with donning, still other factors are addressed in the design of a gown. It is, for example, important that the gown fits snugly about the wearers' body at such openings as the cuff openings of the sleeves and the neck opening (the lower portion of the operating room personnel below the table length is generally considered unsterile and hence the fit of the lower portions is less important). Accordingly in designing the cuffs of such gowns consideration must be taken of two, perhaps conflicting, criteria. Firstly, the cuffs must fit snugly around the wearer's wrists so as to avoid contamination and exposure of the body and, in particular, so as to remain in place under the cuff of gloves which are placed over the gown sleeve cuff. In conflict thereto, the cuffs must allow for easy donning without undue handling and concomitant risk of contamination of the outer surfaces of the gown.

Similarly, such criteria exist for the neck opening. Such neck opening should fit snugly about the lower portions of the hood of the wearer and hold such portions of the hood firmly in place. At the same time, the neck opening must allow for easy donning without undue handling and contamination risk.

Additionally, in considering the gown design, both from the point of view of commercial practicality and comfort for the user, provision must be made for varying the size of a given gown to accommodate the particular dimensions of the wearer. Moreover, it is important that the gown does not unduly blouse or billow in that this will interfer with the procedures to be performed by the wearer.

Heretofore, while attempts have been made, in part, to address each of these criteria, there has not been a satisfactory solution to these problems.

SUMMARY OF THE INVENTION

In accordance with the general teachings herein, a protective garment such as a surgical gown is provided, which garment is endowed with features that facilitate the donning thereof in accordance with current aseptic principals, which maintains a tight fit to proclude contamination during use, and which is both comfortable and usable by a wide range of differently sized wearers. Specifically, the gown is provided in a folded state most suitable for over-the-head donning. The gown is provided with cuffs which maintain a tight fit about the wearer's wrists and insure, proper positioning with respect to the wearer's gloves as the wearer goes about his or her tasks in the operating room. The gown is further provided with a neck opening and closure means therefor that insure a snug fit about the wearers' protective hood while maintaining comfort. Certain other features are provided to ensure fit and comfort in use by a wide range of variously sized wearers.

In one aspect of this invention, a folded protective garment is provided which, in its unfolded state comprises a front, back, top, and bottom portions of a gown-like garment having a bottom opening and an opposed neck opening and having sleeves with sleeve openings to accommodate the arms of the wearer. The garment is folded in a manner such as to facilitate the over-the-head donning of the garment in an aseptic manner, i.e. to facilitate the donner's ability to insert his head through the bottom opening and his arms into the sleeves, pass the garment over his body and have his head and hands emerge from the neck and sleeve openings, respectively.

The folding comprises having a first lower most portion of the garment bottom being inverted (i.e. turned inside out) over a second contiguous next portion of the garment. This inverted portion is then inverted over a third contiguous portion of the garment. The portions of the garment are selected to be dimensioned so that essentially all but the portion of the garment adjacent the neck opening are overlayed with inverted garment portions, with the body of the so folded garment, opposite the neck portion, being open to receive the donner's head and arms.

The sleeves of the garment are also inverted and are drawn down, within the folded garment, toward the bottom of the folded garment with the sleeve openings being accessible to the donner through the open bottom of the folded garment. Additionally, the adjacent neck opening portions are inverted and drawn down, within the folded garment, toward the bottom of the folded garment, with the neck opening being accessible to the donner through the bottom opening of the folded garment.

Accordingly, the donner may insert his hands into the sleeve openings and his head into the neck opening. With the assistance of a non-sterile person who need grip only the inside surface of the garment, the inverted portions may be drawn down about the body of the donner while his arms and neck re-invert the sleeve and neck portions all without touching the outside surfaces of the garment.

In another aspect of this invention a cuff assembly for the hand opening end of the sleeve of a protective garment is provided which cuff assembly will ensure a tight fit and the retention of the cuff within a subsequently donned glove. The cuff assembly, in accordance with this invention, is particularly useful in conjunction with the folded garment described above in that it allows for easier donning and re-inverting of the sleeves.

The cuff assembly of this invention comprises a cylinder of fabric having a sleeve opening at one end of the cylinder and a hand opening at the opposed end. The sleeve opening end is affixed peripherally to the sleeve opening end of the protective garment. The hand opening end is left open to accommodate the passing therethrough of the four digits and adjacent portions of the palm of the garment wearer's hand. The cuff assembly is further provided with a thumb engaging restraint which allows the passage therethrough of the garment wearer's thumb while restraining further passage of the hand through the cuff. Accordingly, when the donner passes his hand through the sleeve and out through the cuff, the cuff will allow the four digits, most of the palm and the thumb to emerge therethrough but will then have the hand restrained from any further portion passing therethrough ensuring that the cuff remains tightly in place about the wearer's wrist and the adjacent portions of his palm. Thus, for example, such a cuffed sleeve cannot escape the confines of subsequently donned glove. Moreover, when donning a garment folded in accordance with the teachings of this invention as described above, the thumb engaging restraint provides a means whereby the donner can easily cause the sleeves to reinvert.

In still another aspect of this invention, the portions of the gown adjacent to the neck opening are provided with means for allowing the neck portion to be easily accessible to the donner, particularly when donning a folded gown in the manner described herein, yet may be readily tightened about a surgical hood.

In several other aspects as will be described in greater detail herein, means are provided for insuring good fit and comfort.

BRIEF DESCRIPTION OF THE DRAWINGS

The aforementioned and other advantages of the present invention will become apparent upon consideration of the following detailed description taken together with reference to the appended drawings in which.

DETAILED DESCRIPTION OF THE INVENTION

Figure 1:
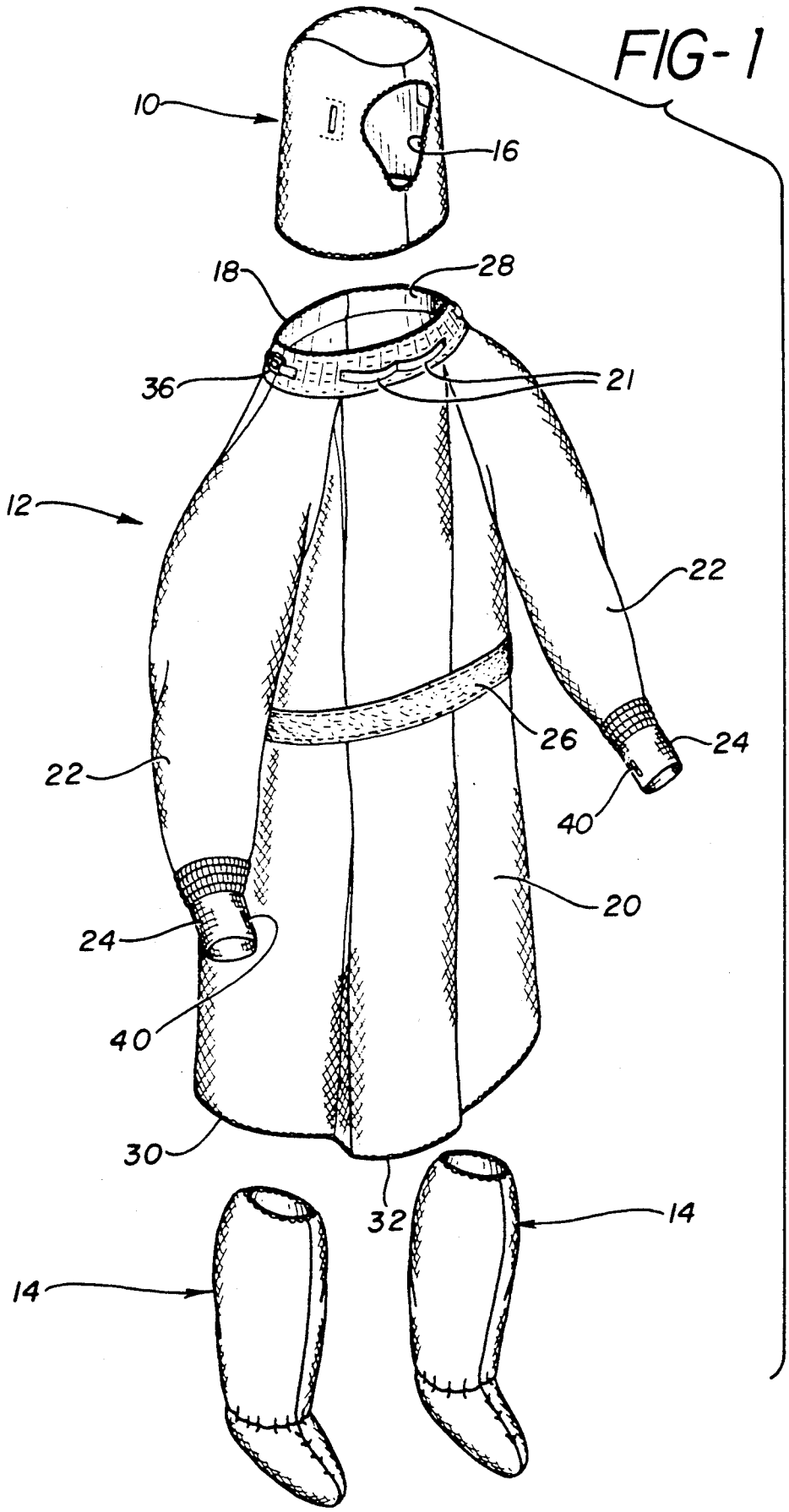
FIG. 1 is an exploded, perspective view of a protective hood, garment and boots which incorporate the teachings of this invention.
Figure 2:
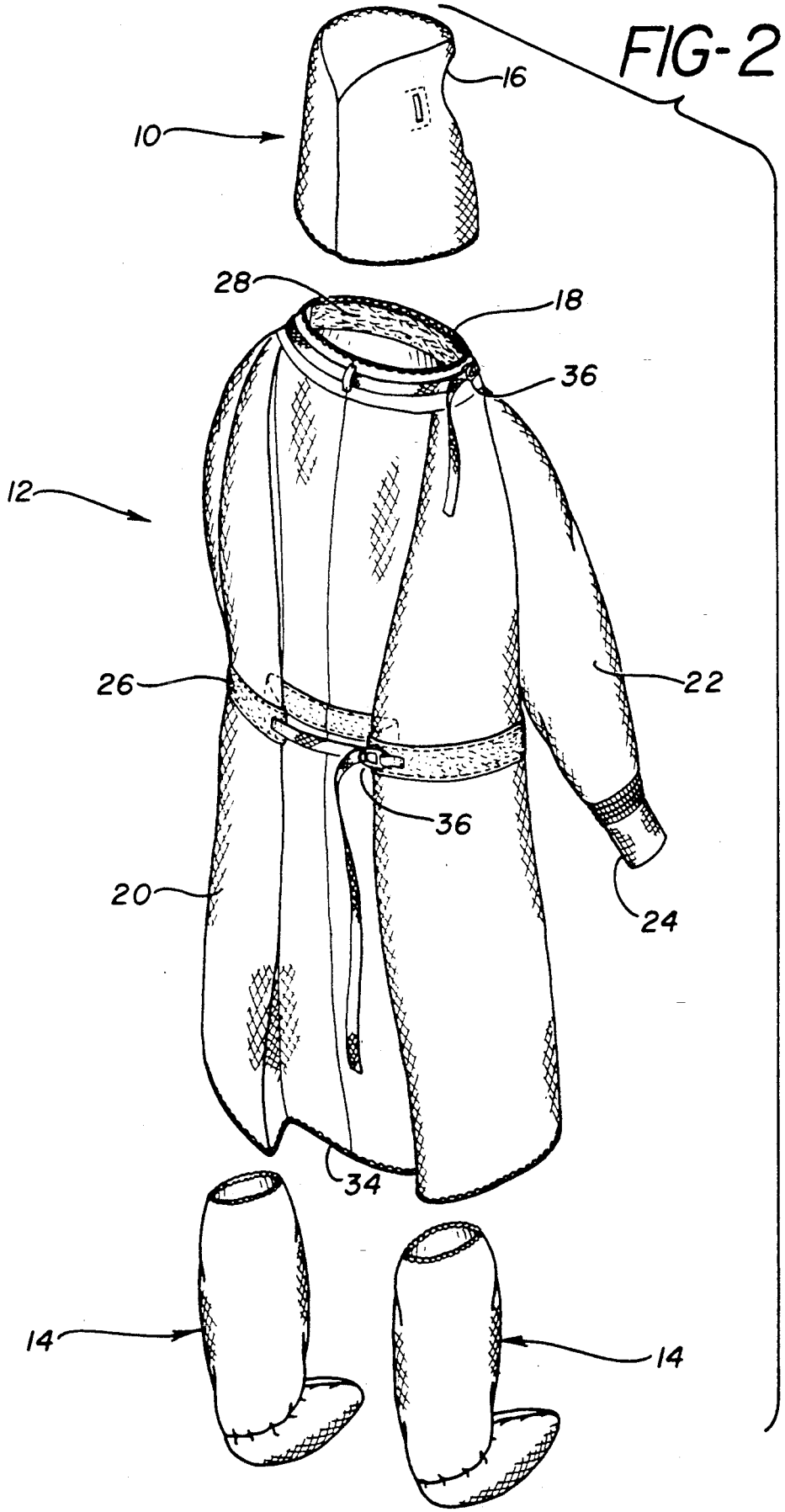
FIG. 2 is an exploded, perspective rear view of the protective hood, garment and boots of FIG. 1.

Referring now to FIGS. 1 and 2, shown therein, in exploded view, are respectively, the front and back portions of the protective outfit that is the subject matter of this invention. Such outfit comprises a hood 10, a gown 12 and boots 14. Hood 10 is provided with a face opening 16 and is adopted to protect the entire head of the wearer. Hood 10 is adapted to fit snugly into neck portions 18 of the gown 12. The gown 12 comprises a main body portion 20, sleeves 22 ending in cuffs 24, a waist portion 26, a neck opening 28 as well as a bottom opening 30. The protective gown 12 is provided with front pleat 32 and back pleat 34 and closure means 36. The neck opening 28 surrounded by neck portion 18 is closed by a second closure means 36.

The hood, boots and gown may be fabricated from any of the suitable fabrics now known for such protective garments. Typically such fabrics are fluid repellant and fire retardants and are designed to be comfortable in weight, drapable and soft. Woven fabrics such as print cloth, cambric, lawn, longcloth, muslin, nainsook, poplin, broadcloth and the like, prepared with repellant and/or retardant finishes, may be employed. Cotton and polyester are most usually the fibers of choice but nylon or acrylic fibers may also be employed. Such woven gowns are generally reused after laundering and sterilization. Recently, however, the majority of operating gowns have been made of the disposable materials i.e., materials employed in garments which are to be used one time only, such materials generally being nonwoven fabrics. Most appropriate are fabrics such as those disclosed in U.S. Pat. No. 4,501,792 and U.S. Pat. No. 4,705,712. The nonwoven fabrics chosen may include melt blown materials, spun bonded fabrics, fusable fabrics, impregnated fibrous webs and the like. All should be treated so as to be fluid repellant and fire retardant. The fabrics may contain synthetic or cellulosic fibers and may be of continuous filament or staple fiber and may even contain some short fibrous wood pulp such as in tissue or ground wood pulp. In recent developments, gown fabrics are prepared so as to create barriers to the transmission of micro-organisms and particularly to create barriers to viral organisms. These fabrics are generally laminates of a microporous film having moisture vapor transmission properties and laminated to a facing material. A particularly useful film component is that disclosed in our copending U.S. patent application Ser. No. 584,301 filed on Sept. 18, 1990. The nonwoven fabrics such as those described above can serve as the facing components of the laminate. Again, the nonwoven fabric element used in such laminate should be treated to be fire retardant and fluid repellant. The preferred fabric is that described in U.S. Pat. No. 4,501,792.

As described herein, the protective garment of this invention is one which is designed for over-the-head donning. That is to say, the wearer will place his head and arms through a folded bottom opening 30' of gown 12, have the body 20 of the garment 12 pulled over his body and thrust his head through neck opening 28 where his arms will be thrust through sleeves 22 with his hands emerging through cuffs 24. In accordance with the teachings herein this garment 12 is folded in such a manner as to facilitate the aseptic donning thereof.

Figure 11:
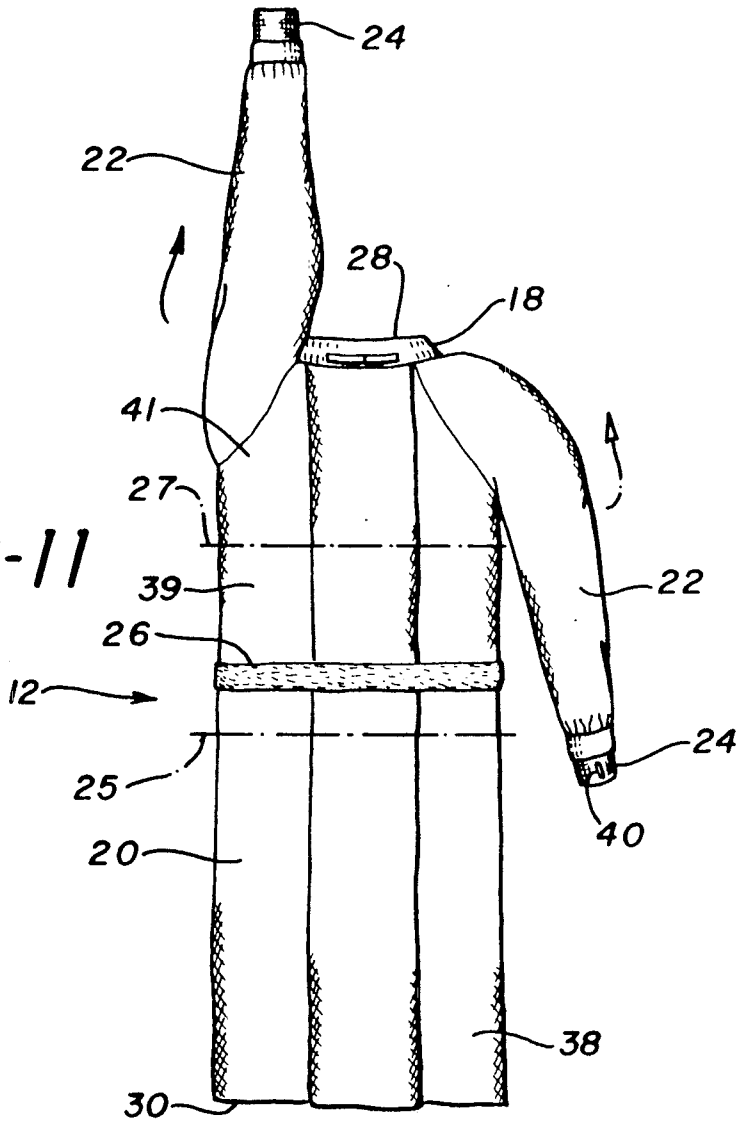
FIG. 11 is a plan view of the garment of the invention prior to being folded in accordance with the teachings herein.
Figure 15:
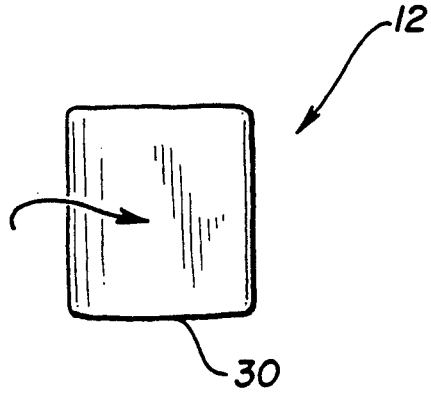
FIG. 15 is a plan view of the garment in a final stage of folding.
Figure 16:
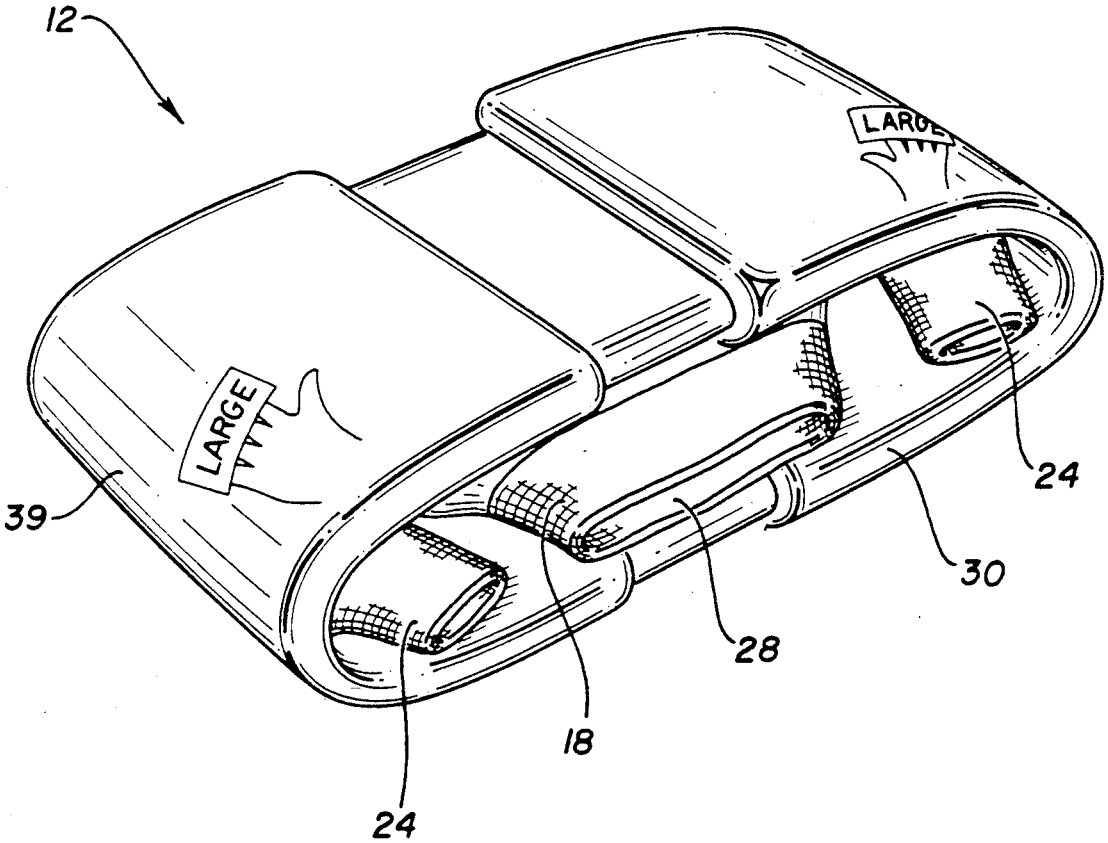
FIG. 16 is a front perspective view of the folded garment as presented to the donner.

Referring now to FIGS. 11 through 16 illustrated therein is the folding of the garment 12 to produce a folded garment, best illustrated in FIG. 16, which facilitates such aseptic donning. FIG. 11 illustrates the garment in plan view and in its unfolded state. It will be understood that the steps of folding are described herein in a particularly sequence and the particular methods of folding are exemplified by this description. However, the invention is not limited thereto and instead other sequences or methods, both manual and mechanical, may be employed to produce essentially the equivalent folded garment exhibiting the advantages of our invention.

Figure 12:
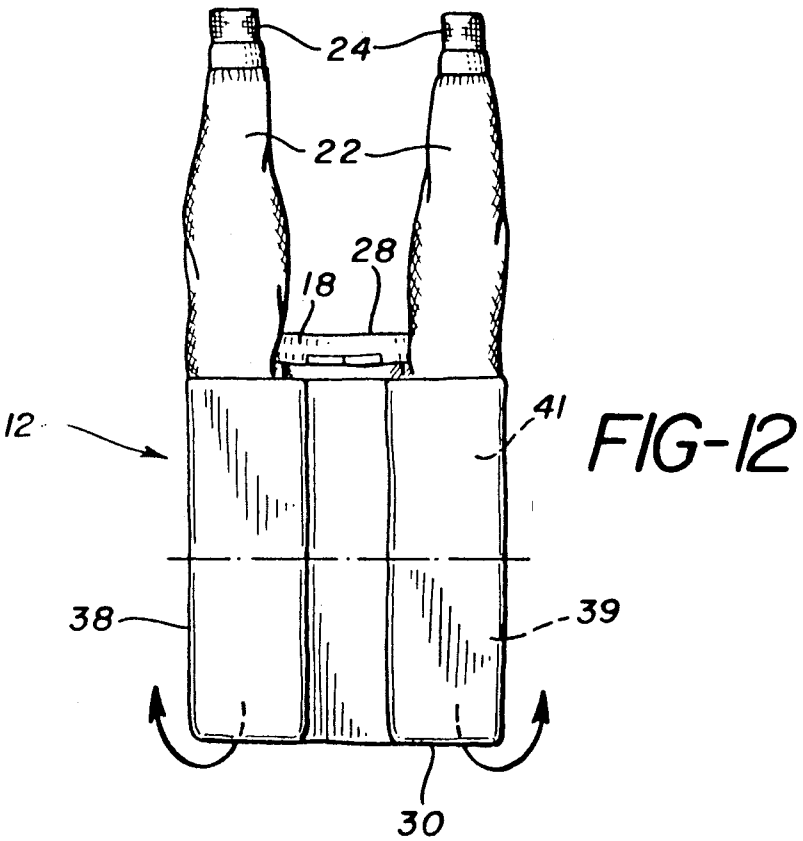
FIG. 12 is a plan view of the garment of FIG. 11 in an intermediate stage of foldings.

In FIG. 11, the first step is to extend the sleeves 22 above the top of the garment; that is to say, as illustrated in FIG. 12, the left sleeve is to be elevated to the position of the right sleeve so that both sleeves extend above the neck portion 18 of the garment 12. The next step is to invert the first lower most portion 38 of the garment over the second contiguous next portion 39 of the garment and preferably, as illustrated in the drawings, over the third contiguous portion 41. For the convenience of the viewer, portions 38 and 39 are defined by dotted lines 25 and 27 and it will be understood that position of lines 25 and 27 may be varied in accordance with the length of the garment and the particular design of the garment, taken together with the considerations of ease of donning.

Figure 13:
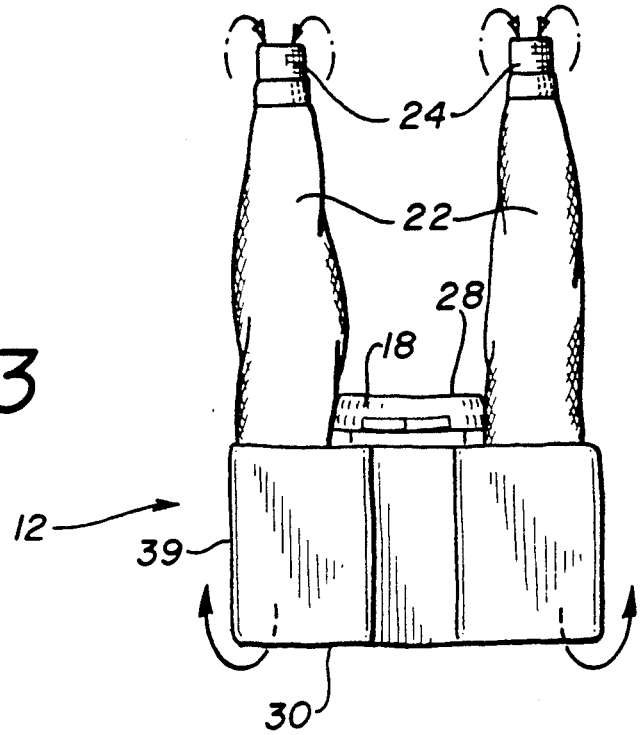
FIG. 13 is a plan view of the garment of FIG. 12 in a further stage of folding.
Figure 14:
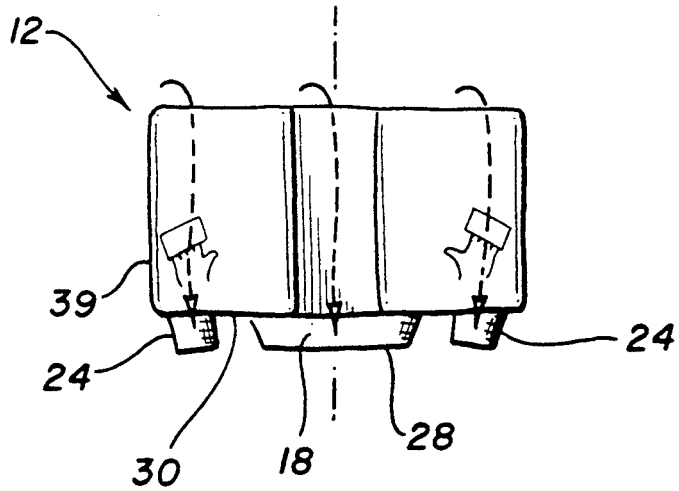
FIG. 14 is a plan view of the garment of FIG. 13 in a still further stage of folding.

Illustrated in FIG. 12 is the garment in an intermediate stage of folding. As shown the first lower most portion of the garment bottom 38 has been inverted over portions 39, the second contiguous next portion of the garment and section 41 the third next contiguous portion. As shown by the arrows in FIG. 12 portion 38 and its underlying portion 39 are now once more inverted over portions 41 such that all but the sleeves and the portion surrounding the neck opening are exposed over the top of the folded garment. It will be appreciated that in this position the garment has an open bottom and presents essentially only the inside surfaces of the garment. FIG. 13 illustrates the garment in this second inverted position with only the inside surfaces exposed. With the garment so folded sleeves 22 are next inverted in accordance with the direction of the arrows and are drawn down and into the folded body of the garment so as to assume the position shown in FIG. 14 with the sleeve openings being accessible to the donner through the open bottom of the folded garment. Similarly, the adjacent neck opening portions are inverted and drawn down within the folded garment towards the bottom of the folded garment with the neck opening being accessible to the donner through the bottom opening of the folded garment. The folded garment shown in this position is illustrated in plan view in FIG. 14 and in perspective view in FIG. 16. Logo 40 may be placed on the inside surfaces of the garment to indicate size and indicate the places in which the donner should begin the donning of the garment. As illustrated in FIG. 15, for convenience, the folded garment may be folded longitudinally so as to present a smaller package.

It would be understood then, with reference to FIG. 16 that the donner may insert his hands into the sleeve openings and his head into the neck opening. With the assistance of a non-sterile person, who needs to grip only the inside surface of the garment, the inverted portions may then be drawn down about the body of the donner while his arms and neck reinvert the sleeves and neck portion. All of this may be accomplished by contact with only the inside surfaces of the garment.

In another aspect of this invention a cuff assembly for the hand opening end of sleeve 22 of the protective garment 12 is provided. The cuff assembly is designed to ensure tight fit in retention of the cuff within a subsequently donned glove. Additionally, as will be seen, the cuff assembly provides an advantage when the garment is folded and donned in accordance with the teachings described above.

Figure 6:
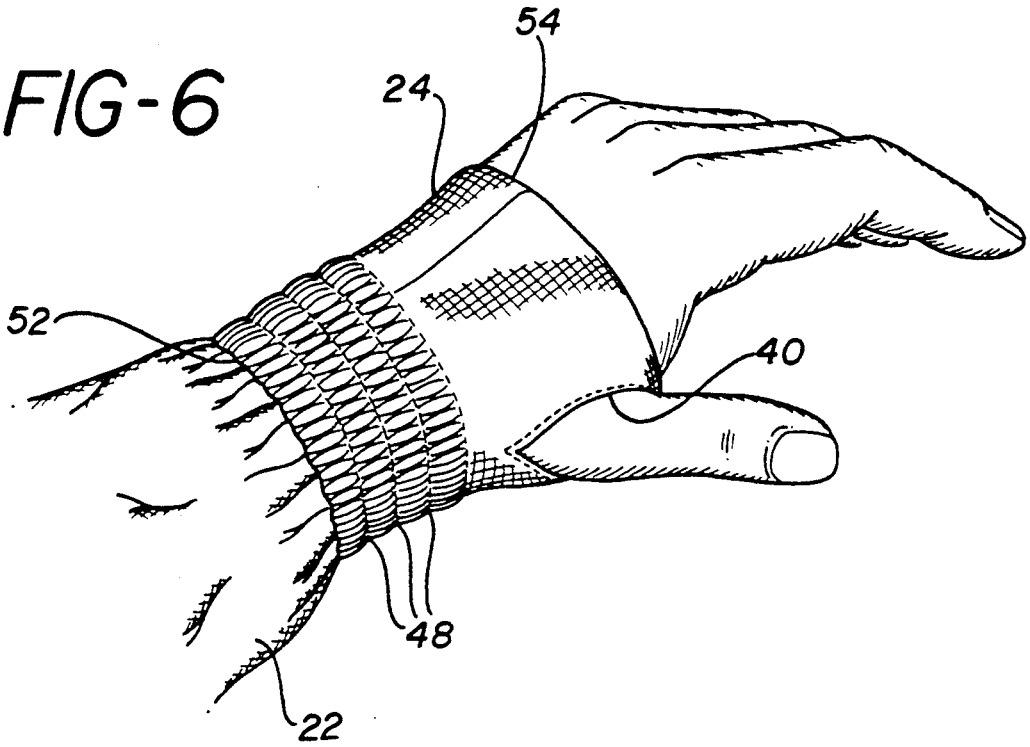
FIG. 6 is perspective view of the wearer's hand extending from the glove assembly and incorporating the teachings herein.
Figure 7:
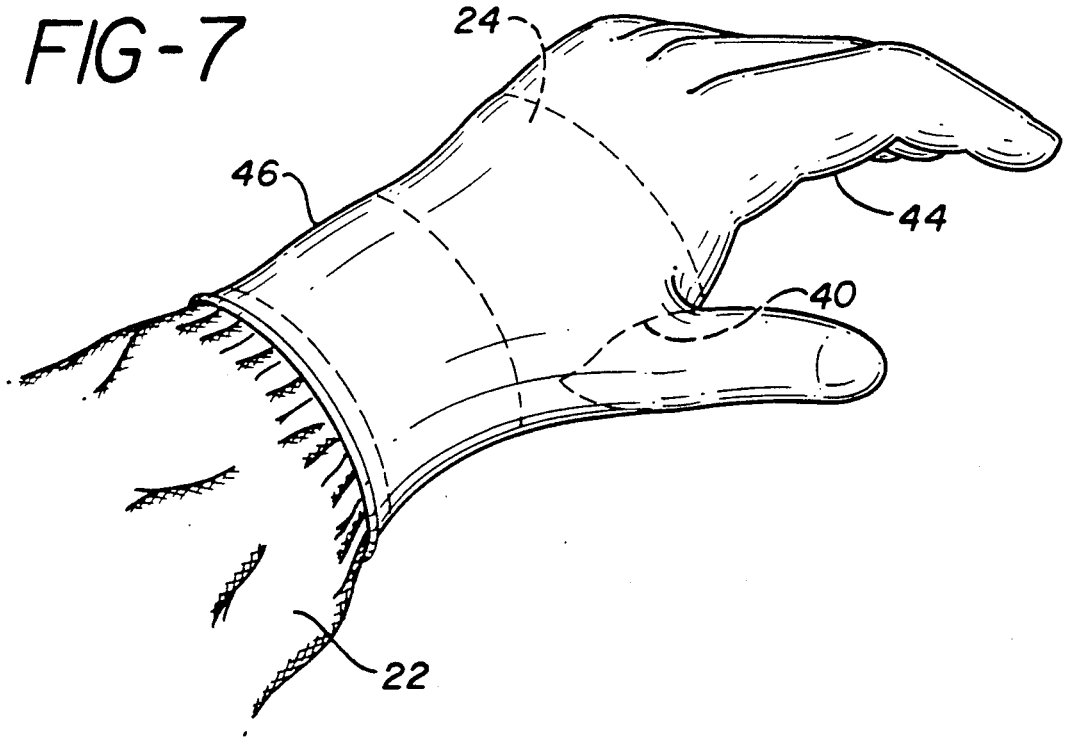
FIG. 7 is the same view of the wearer's hand after the wearer has donned a surgical glove.

Referring now to FIGS. 6 and 7 the cuff assembly 24 of this invention comprises a cylinder of fabric having a sleeve opening end 52 and a hand opening 54 at the opposed end. The sleeve opening end 52 is affixed peripherally to the sleeve opening of the protective garment 12. The hand opening end is left open to accommodate the passing therethrough of the four digits and adjacent portions of the palm of the garment wearer's hand as is illustrated in FIG. 6. In accordance with the teachings herein, the cuff assembly 24 is further provided with a thumb engaging restraint 40 which allows the passage therethrough of the garment wearer's thumb while restraining further passage of the hand through the cuff. Accordingly, when the donner passes his hand through the sleeve and out through the cuff, the cuff will allow the four digits, most of the palm, and the thumb to emerge therethrough, but will then have the hand restrained from any further portion passing therethrough, ensuring that the cuff remains tightly in place about the wearer's wrist and the adjacent portions of his palm. Thus, for example, such a cuff cannot escape the confines of a subsequently donned glove 44 as is shown in FIG. 7. Instead, the cuff assembly remains firmly in place under the cuff 46 of glove 44.

The thumb engaging restraint 40 may take various forms provided it functions as a means for engaging the thumb and restraining the further passage of the palm through the cuff assembly. Accordingly, if such thumb engaging restraint may be a loop sewn to the inside or outside surface of the sleeve assembly. In a preferred embodiment, as illustrated in FIGS. 6, 7 and also FIG. 1, the cuff assembly may comprise a slit formed in the portion of the cuff assembly adjacent the hand opening in 54 through which the thumb may pass. The material surrounding the slit then serves as the thumb engaging restraint.

It will be appreciated that the thumb engaging restraint is particularly useful in conjunction with the folding and donning of the garment as described above. The donner may, when inserting his hands into the cuffs, engage the thumb engaging restraint and then, automatically, reinvert the sleeves as he dons the garment.

To ensure that a tight fit about the wrist of the wearer is provided, the cuff assembly should be made of a material which has the both and stretch and recovery properties. Additionally, the materials should provide some comfort and perferably be absorbent so as to absorb perspiration. The stretch and recovery properties may be achieved from the construction of the material such as employing knitted materials, knitted with a rib and interlock knit and made on a circular knit machine including, for example, double knits. Elastic properties may be developed by using warp knits employing elastic yarns such as lycra. Additionally, woven fabric, preferably in a twill or satin weave using lycra, rubber or other elastic yarns may be employed. Milamo structures containing elastic elements such as rubber or lycra may be used. Elastic nonwoven, such as certain spun bonds and melt blowns as are known in the art may be also be employed as well as such microcreped thermoplastic nonwovens. Additionally, certain woven fabrics using microdenier fiber and fibrolated fiber can be manufactured having stretch and recovery properties and would also be usable. The preferred cuff material is a circular interlock knit.

The cuff material is attached to the hand opening of sleeve 22 by stretching the cuff and affixing it to sleeve 22 with subsequent relaxation of the cuff material. Such relaxation causes the body fabric of sleeve 22 to become puckered and adds to the comfort of the user. As illustrated in FIGS. 6 and 7 a plurality of a elastic elements 48 are affixed to the cuff material in a stretch position and then allowed to relax, thus providing the snug and comfortable fit around the wrist. Attachment of the cuff assembly to the sleeve may be accomplished any methods known in the art such as stitching, glueing, sonic bonding, and the like.

The considerations surrounding the snugness of fit and comfort of the cuff assembly are likewise applied when considering the design of the neck portions 18 of the garment 12. These neck portions should fit snugly about a surgical hood such as hood 10 and should provide comfort when worn. Accordingly, in accordance with the teachings herein, such neck portions are preferably chosen as a cylinder of material affixed to the neck opening 28 of the garment 12. In the case of the neck opening portions 18, however, such cylinder of material may simply line the inside surfaces of the portions adjacent the neck opening 28 of garment 12 and be affixed thereto by means described in conjunction with the cuff assembly. It is advantageous for such material to have stretch and recovery properties and form a puckered surface. Accordingly, the materials of construction and means for attaching the same should be chosen as has been described above in conjunction with the cuff assembly.

Figure 10:
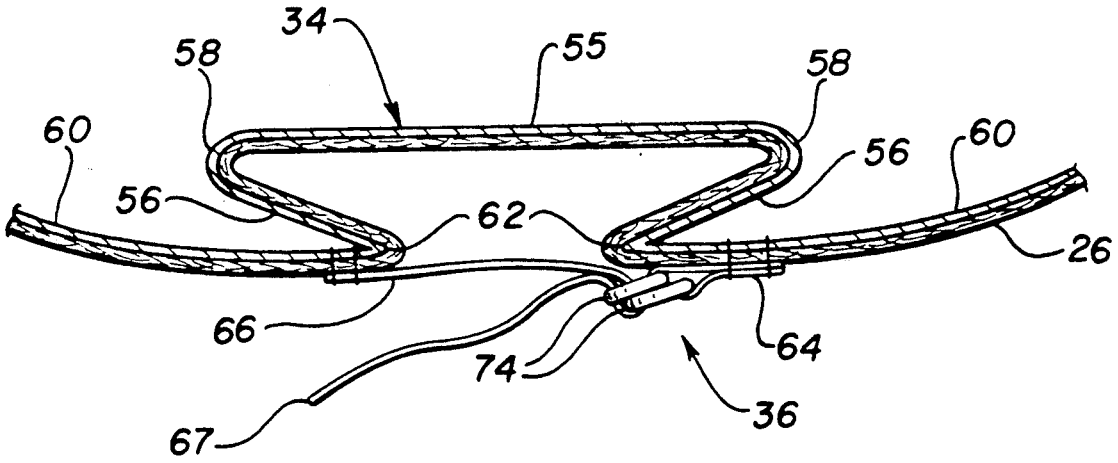
FIG. 10 is a schematic cross sectional view of the fastened belt of FIG. 9.

In still another aspect of this invention the garment 12 is designed so as to accommodate various sized wearers and at the same time avoid billowing or blousing when worn. This feature, together with ease of donning, is accomplished by the inclusion of front pleat 32 and back pleat 34, which pleats preferably run longitudinally throughout the full length of the front and back of the garment. Referring now to FIGS. 1, 2 and 10 illustrated therein is the garment 12 with front pleats 32 and back pleats 34 and in FIG. 10 a schematic cross sectional view of back pleat 34. With reference to back pleat 34 it can be seen that the back of garment 12 comprises a central longitudinal panel 55 with adjacent panels 56 on either side thereof. The remainder of the back of garment 12 are the panels 60 contiguous with side panels 56. To form the pleat, panels 56 are folded about fold lines 58 so as to have the outside surface of 56 faced toward the outside surface of panel 55. Additionally, portion panel 60 are folded about fold lines 62 so as to have the inside surfaces of panel 60 faced toward the inside surface of panel 56. The pleat 32 is formed in a similar manner.

Figure 8:
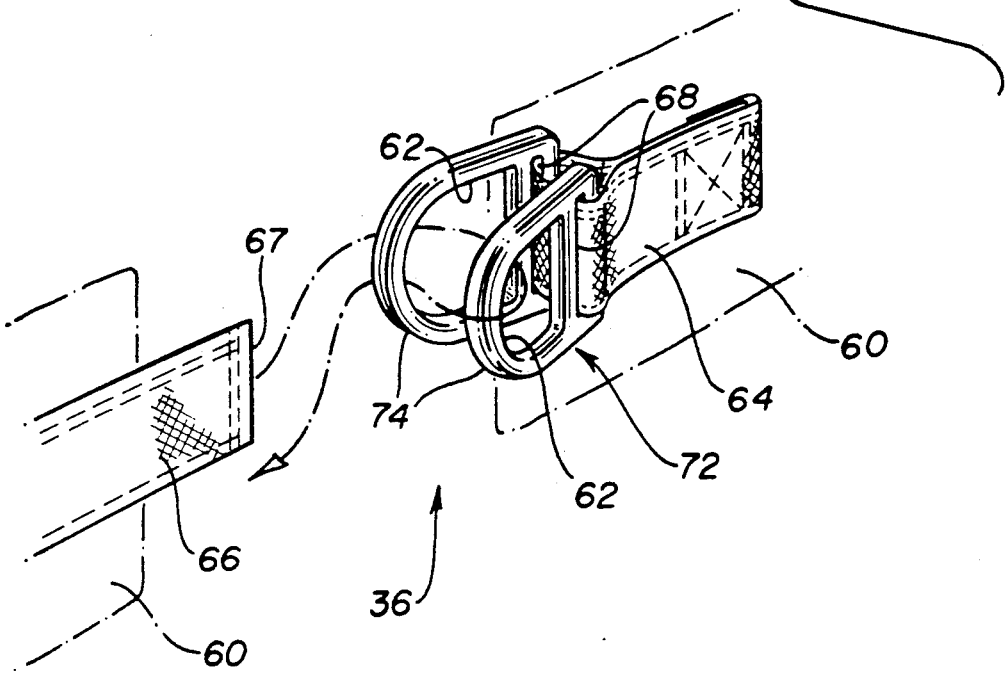
FIG. 8 is a perspective, schematic view of the belt fastening means for the garment incorporating the teachings herein and shown before the belt is fastened.
Figure 9:
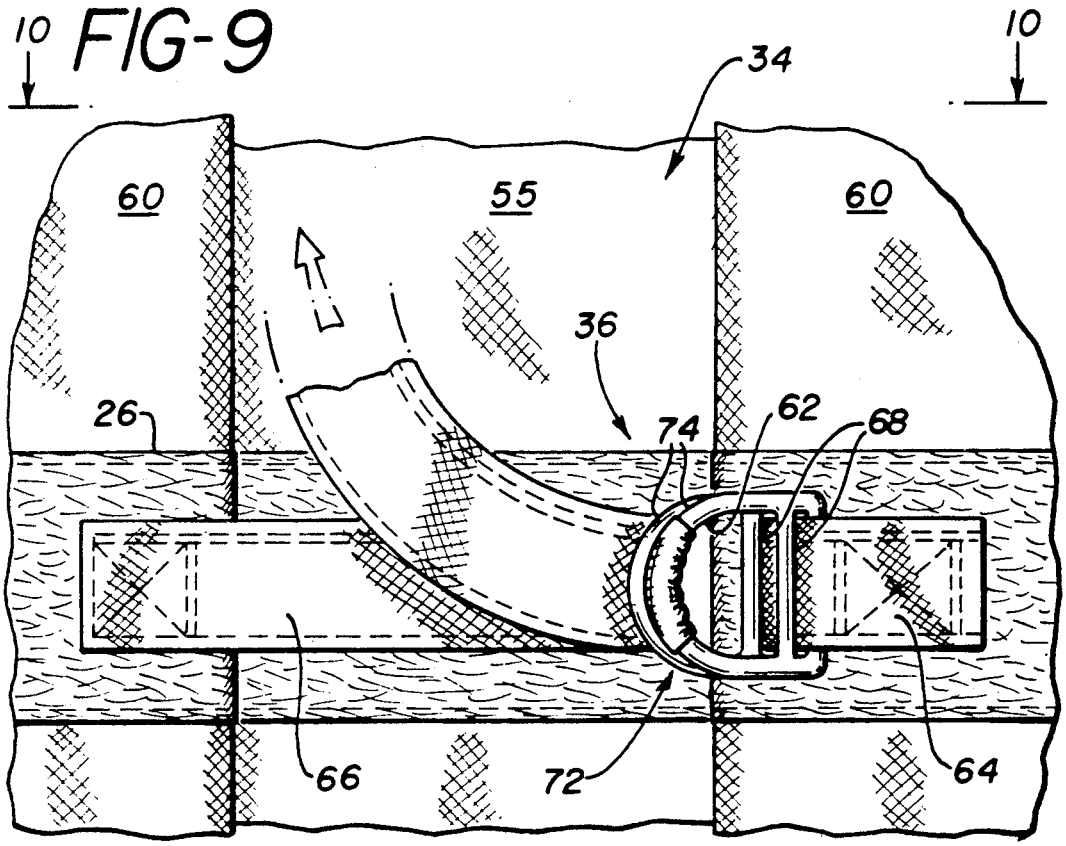
FIG. 9 is a front, elevational view of the belt folding means of FIG. 8 after the belt is fastened.

Once the garment is donned, the pleats may then be closed by use of an adjustment closure 36. Referring now to FIGS. 8 and 9 illustrated therein is such an adjustment closure generally described in FIG. 10. The adjustment closure comprises a belt 66 affixed to panel 60 and having an extending loose end 67. The loose end is adopted to be engaged by a buckle assembly shown generally as 72 affixed to the opposed panel 60 by a buckle strap 64. The buckle strap is adapted to be affixed at one end to panel 60 and to terminate at the other end in a loop which passes through buckle slits 68 of each of two buckles 74. The buckles are provided with belt loops 62 through which the leading end 67 of belt 66 is threaded along the path shown in FIG. 8. Specifically, belt 66 is threaded from the inside facing surface of the buckle loop of the inner buckle and therethrough, then from the inside surface of the buckle loop of the outer buckle and therethrough and then from the outside surface of the inner buckle loop and therethrough. The buckled belt is illustrated in FIGS. 9 and 10 and presents a particularly advantageous property. Namely, after having been buckled in the manner described above, any force directed on panels 60 so as to tend to pull such panels apart will force the outermost buckle into closer contact with the innermost buckle and increase the frictional engagement between the belt entrapped therebetween thereby resisting the pulling apart of panels 60.

Figure 3:
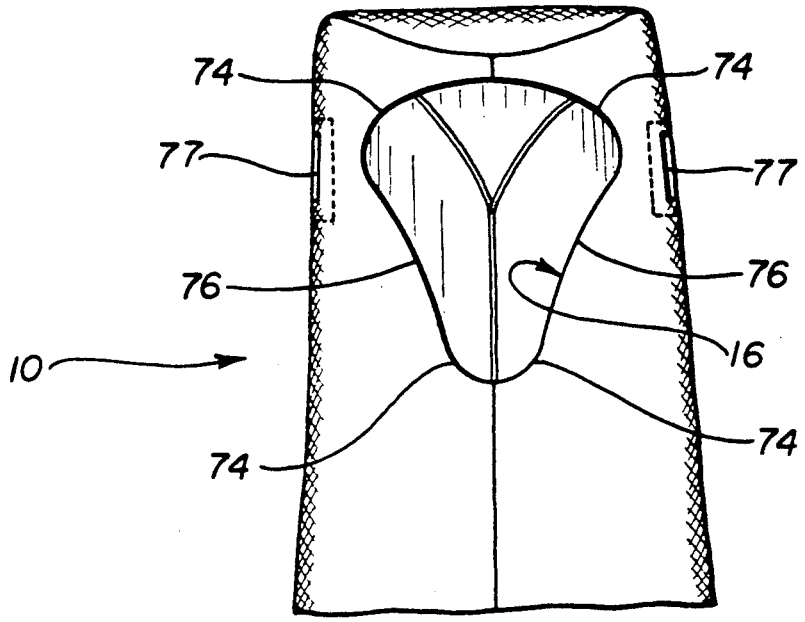
FIG. 3 is a front elevational view of the protective hood incorporating the teachings herein.
Figure 4:
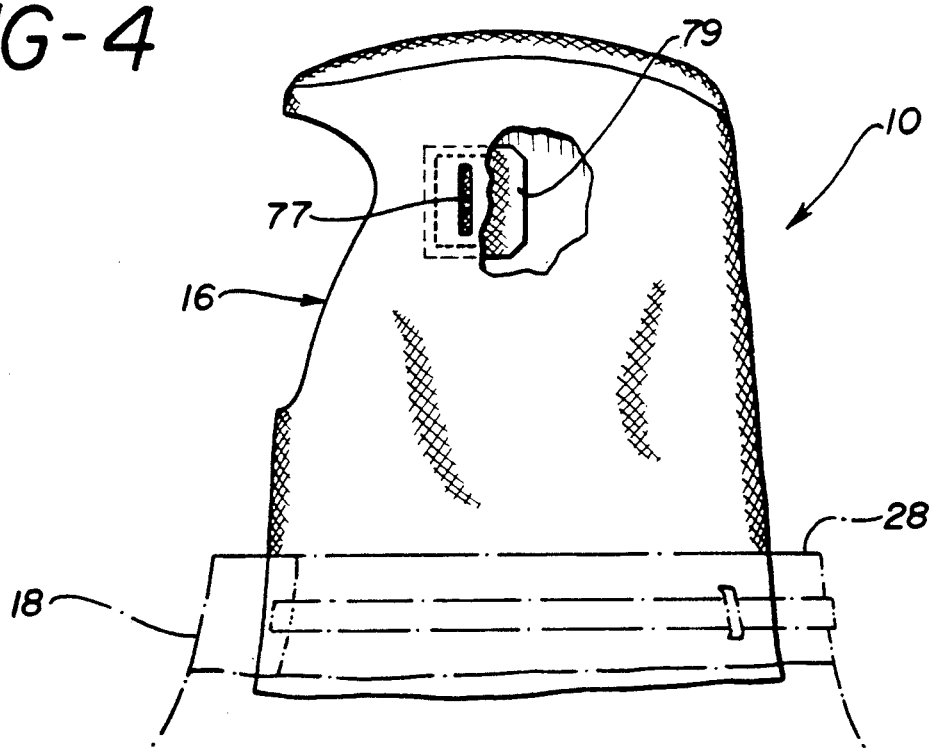
FIG. 4 is a side elevational view of the hood of FIG. 3.

Closure 36 has been described in conjunction with the closing of pleat 34 about the waist portion of garment 12. It will be appreciated that the same kind of buckling mechanism is useful in closing the pleat around the neck portions 18 of the garment 12. This is particularly advantageous in tightening the garments to fit snugly about a surgical hood 10, such as is illustrated in FIGS. 3 and 4. In still an additional feature of the gown of this invention the neck portion 18 is conveniently provided with loops 21 which loops provide a means for gripping the neck and pulling it away from the wearer so as to facilitate donning and removing of the garment.

In still another aspect of this invention, the garment is provided with an absorbent strip of material 26 which encircles the waist portion of the garment. This absorbent strip is designed to preclude fluids and other body exudate from continuing in a path down the uppermost portion of the garment and on to the floor. Such path of fluids is intercepted by the absorbent strip and passes laterally about it, thus preventing blood and other such exudate from forming dangerous and undesirable puddles on the floor of the operating room. The absorbent strip also provides a useful surface for affixing the belt and buckle systems 36.

Figure 5:
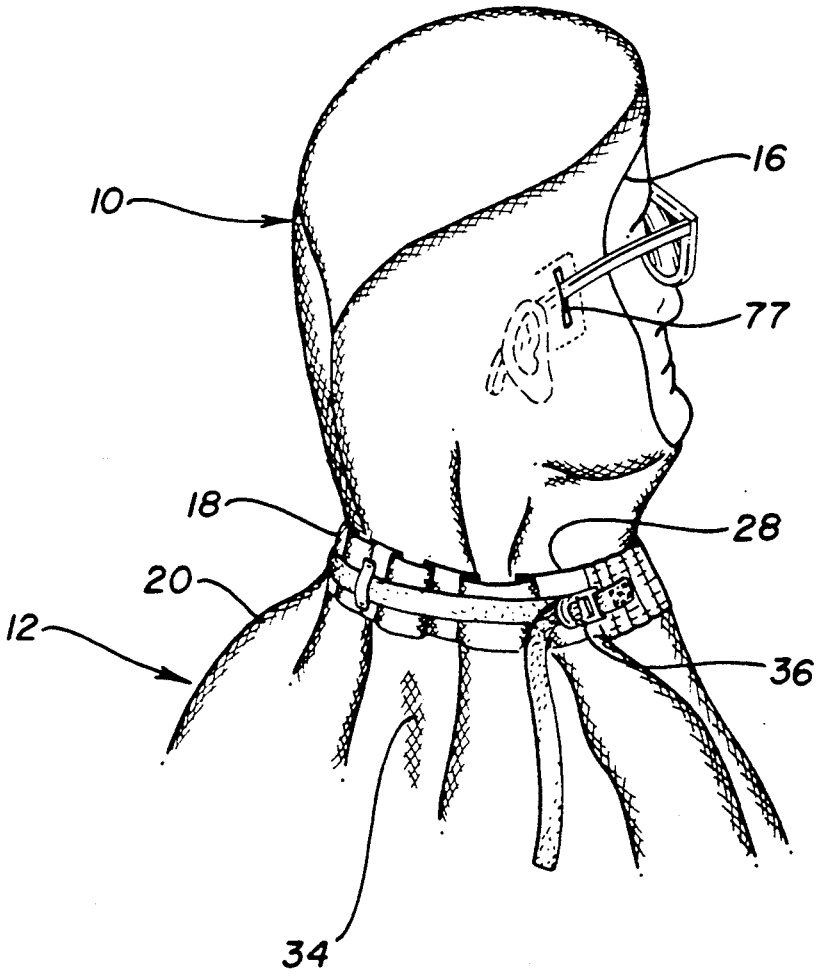
FIG. 5 is a rear perspective view of the upper portions of the wearer, wearing a hood and garment incorporating the teachings herein.

In still a further aspect of this invention, a hood 10 is provided to add to the comfort and aseptic procedures of the operating room. The surgical hood 10 comprises a fabric formed into a head covering which as shown in FIGS. 1, 3, 4 and 5 where it consists of three, fixed together, panels. The head covering is provided with a face opening 16 which, as best shown in FIG. 3, is in a shape of a modified, truncated isosceles triangle. Such triangle is modified from a classic isosceles triangle in that the corners 74 are rounded, the base is preferably rounded, and at least a portion of the equal sides 76 are curved inwardly toward the center of the face opening thereby providing protection for covering the cheek areas of the face of wearer. This is best illustrated in FIG. 5. Additionally, eyeglass earpiece receiving means are provided on each side of the surgical hood. Such means are illustrated by slit 77 which passes through the fabric of the hood and provides communication of the earpiece from the outside of the hood to the inside and then over the ear of the wearer. Protection flap 79 is affixed peripherally about slit 77 to maintain the slit closed about the earpiece when emplaced or to maintain the hood closed when no earpiece is utilized.

What is claimed is:

1. A folded protective garment wherein, in its unfolded state such garment comprises:

a front, back, top, and bottom portions of a gown like garment having a bottom opening and an opposed neck opening and having sleeves with sleeve hand openings to accommodate the hands of the wearer;

said garment having an inside surface and an outside surface;

said folded garment having been folded to facilitate donning by the wearer, said folding comprising:

a first, lowermost portion of the garment bottom being inverted to overlie a second, contiguous next lowermost portion of the garment;

the second portion, together with said overlying first portion, being inverted to overlie a third, contiguous, third lowermost portion of the garment;

said portions of said garment being selected so that essentially all but those portions of the garment adjacent the neck opening being overlain with inverted garment portions, with the bottom of said folded garment, opposite the neck opening, being open;

said sleeves being inverted and drawn down, within said folded garment, toward the open bottom of said folded garment, with the sleeve openings being accessible to the wearer through the open bottom of the folded garment;

said portions adjacent said neck opening being inverted and drawn down within said folded garment toward the open bottom of said folded garment, with the neck opening being accessible to the wearer through the open bottom of the folded garment;

whereby the wearer may insert the wearer's hands into said sleeve openings and the wearer's head into said neck opening and have the inverted portions of the garment be drawn down about the wearer's body as the wearer's arms and neck reinvert the sleeves and neck portions of the garment, thus donning the garment without contaminating outside surfaces thereof.

2. The folded protective garment of claim 1 wherein said sleeve hand openings are provided with a cuff assembly;

said cuff assembly comprising a cylinder of fabric having a sleeve end defining a first opening and a hand end defining a second opening;

said sleeve end being affixed peripherally to the hand end opening of the sleeve of said protective garment to allow the wearer's hand to pass from the hand opening of said sleeve into said first opening and at least a part of the hand to pass out of said second opening;

said sleeve assembly having stretch and recovery properties.

3. The folded protective garment of claim 2 wherein said second opening is opened to accommodate the passage therethrough of the four digits and adjacent portions of the palm of the wearer of the garment; and said cuff assembly is further provided with a thumb engaging restraint means, said thumb engaging restraint means adopted to allow the passage therethrough of the thumb of the hand of the wearer while restraining the further passage of the wearer's hand through the cuff.

4. The folded protective garment of claim 3 wherein said thumb engaging restraint means comprises a slit in said cylinder of fabric adjacent to said second opening.

5. The folded protective garment of claim 1 wherein said portions adjacent said neck opening are lined with a absorbent material having stretch and recovery properties.

6. The folded protective garment of claim 5 wherein the outside surface of said neck portions are provided with loops for facilitating the donning and removal of the garment.

7. The folded protective garment of claim 1 wherein said garment is provided with a back pleat extending longitudinally from the bottom to the top of the garment to accommodate varying sized wearers.

8. The folded protective garment of claim 7 wherein said pleat is provided with a waist closure to adjust and close said pleat about the wearer.

9. The folded protective garment of claim 7 wherein said pleat is provided with a neck portion closure for adjustably closing the pleat about the neck portion of the wearer.

10. The folded protective garment of claim 7 wherein said garment is provided with both back and front pleats and both waist and neck closures.

* * * * *